US007244189B1

(12) United States Patent
Stobbe

(10) Patent No.: US 7,244,189 B1
(45) Date of Patent: Jul. 17, 2007

(54) GOLF CLUB WITH HEEL AND TOE WEIGHTING

(76) Inventor: Richard E. Stobbe, 4221 S. 104 th St., Greenfield, WI (US) 53228-2015

( * ) Notice: Subject to any disclaimer, the term of this patent is extended or adjusted under 35 U.S.C. 154(b) by 276 days.

(21) Appl. No.: 10/972,574

(22) Filed: Oct. 23, 2004

(51) Int. Cl.
*A63B 53/02* (2006.01)
*A63B 53/04* (2006.01)
*A63B 53/16* (2006.01)

(52) U.S. Cl. ..... 473/313; 473/325; 473/329; 473/340; 473/341

(58) Field of Classification Search ..... 473/305–315, 473/244–288, 325, 340–341; D21/736–746
See application file for complete search history.

(56) References Cited

U.S. PATENT DOCUMENTS

| | | | | | |
|---|---|---|---|---|---|
| 550,976 | A | * | 12/1895 | Jennings | 473/329 |
| 777,400 | A | * | 12/1904 | Clark | 473/329 |
| 1,154,490 | A | * | 9/1915 | Davis | 473/329 |
| 1,352,020 | A | * | 9/1920 | Olson | 473/246 |
| 1,537,711 | A | * | 5/1925 | Spafford | 473/325 |
| 2,708,579 | A | * | 5/1955 | Hugman | 473/246 |
| 2,932,515 | A | * | 4/1960 | May | 473/248 |
| 3,042,405 | A | * | 7/1962 | Solheim | 473/313 |
| 3,061,310 | A | * | 10/1962 | Giza | 473/329 |
| 3,770,279 | A | * | 11/1973 | Phinny | 473/313 |
| D229,622 | S | * | 12/1973 | Bartron | D21/738 |
| D238,285 | S | * | 12/1975 | Ross | D21/739 |
| 4,073,492 | A | * | 2/1978 | Taylor | 473/409 |
| 4,123,056 | A | * | 10/1978 | Nakamatsu | 473/234 |
| 4,147,357 | A | | 4/1979 | Strop | |
| 4,174,108 | A | * | 11/1979 | Reinholz | 473/247 |
| 4,398,965 | A | * | 8/1983 | Campau | 148/522 |
| 4,438,931 | A | * | 3/1984 | Motomiya | 473/346 |
| 4,951,949 | A | | 8/1990 | Kastenhuber | |
| 5,116,047 | A | * | 5/1992 | Phelan et al. | 473/307 |
| 5,346,219 | A | * | 9/1994 | Pehoski et al. | 473/325 |
| 5,415,399 | A | * | 5/1995 | Kettelson | 473/239 |
| D360,008 | S | * | 7/1995 | Solheim | D21/738 |
| 5,505,447 | A | | 4/1996 | Mockovak | |
| 5,533,728 | A | * | 7/1996 | Pehoski et al. | 473/252 |
| 5,577,968 | A | | 11/1996 | Pritchett | |
| D380,800 | S | * | 7/1997 | Matsuoka | D21/738 |
| 5,910,055 | A | | 6/1999 | Bennett | |

(Continued)

*Primary Examiner*—Sebastiano Passaniti

(57) ABSTRACT

A golf club is disclosed that can be used with a structure of a golf club head that has a space between the front striking face and the back piece of the club head. The front face and the back piece are attached to each other at the heel edge and the toe edge. This new club head can replace the presently used perimeter weighting with this new heel and toe weighting. This new club head is able to strike a golf ball more accurately and with more control. With rotation of the shaft on the club head, the golf club can become a four way device whereby the front face, the back face, the heel edge or the toe edge may be used to strike a golf ball. With a rotatable shaft that is moveable on the golf club head at the heel edge, at the toe edge or at the central part of the back piece, the golf club can become a four way device for a left hander or a right hander. The front face, the heel edge, the toe edge or the back face can be used to strike a golf ball. An adjustable length or telescopic shaft allows more control and accuracy to strike a golf ball.

1 Claim, 2 Drawing Sheets

U.S. PATENT DOCUMENTS 5,924,938 A * 7/1999 Hines ..... 473/307
D421,635 S * 3/2000 Whitley ..... D21/738
6,033,319 A 3/2000 Farrar
6,068,560 A 5/2000 DeLuca
6,440,009 B1 8/2002 Guibaud et al.
6,605,008 B1 * 8/2003 Kovarik ..... 473/329
6,682,439 B2 * 1/2004 Brown ..... 473/329

* cited by examiner

GOLF CLUB WITH HEEL AND TOE WEIGHTING

BACKGROUND

Almost all of the golf clubs made today have a club head where the front striking face and the back piece are one solid unit. The front face of the club head is usually somewhat flat and wide while the back piece of the club head has some form of perimeter weighting whereby the central portion of the back piece will be recessed in some manner from heel to toe and from top to bottom. The present day shaft of the golf club is usually situated at the heel end of the golf club and fixed in that position for normal addressing of the golf club for the front face. Some putters will place the shaft in a fixed position at the central part of an extended back piece with the club head as a solid unit.

This invention relates to a vastly improved system whereby a golfer places a completely rotatable shaft at the heel end, at the toe end or at the central part of the back piece of the club head. The back piece may be extended or be parallel with the front face for ball striking capability. This new club head will differ from the present day club head by having a space between the front face and the back piece of the club head. This will provide a more balanced striking ability to the front face by having the back piece of the club head contribute more mass and stability in a uniform manner to the front face than present day golf clubs do. The golfer may also adjust the shaft for length whereby the golf club has a longer shaft or a shorter shaft.

SUMMARY OF INVENTION

This golf club uses a structure of a club head that has a separate front piece and a separate back piece whereby the two are essentially joined at the heel and the toe with a space between the back of the front piece and the front of the back piece. Instead of just 'perimeter weighting', we have heel and toe weighting which provides a more uniform striking ability for the whole front face. This will allow the front face of the club head to have a larger so called 'sweet spot' and allows the golf club to strike a golf ball more accurately and with greater control.

A telescopic shaft will also allow more accuracy with respect to the distance the ball will have to travel by allowing the shaft to be used in a choke position (a short shaft) or in a full length position for greater distance. The shaft is adjustable anywhere between these two positions. A further enhancement is to use the shaft at the heel end, at the toe end or at the central part of the back piece and be lockable and interchangeable in any of these three positions. A further enhancement of this golf club allows the shaft to be continuously rotatable in any of these three positions (heel, toe and central part of the back piece). This allows the club to address the front face, the back face, the heel or the toe and be able to strike the golf ball with any of these. Even though many of the options of selecting the position of a rotatable shaft at the heel end, the toe end, or the middle of the back piece, the shaft could be lockable and fixed in any one of these positions during a round of golf. The golfer has variations of the shaft position available for practice or for a practice round of golf to determine the best and easiest way to use a golf without having to experiment with many different types of golf clubs.

DETAILED DESCRIPTION OF THE INVENTION

Figure 1:
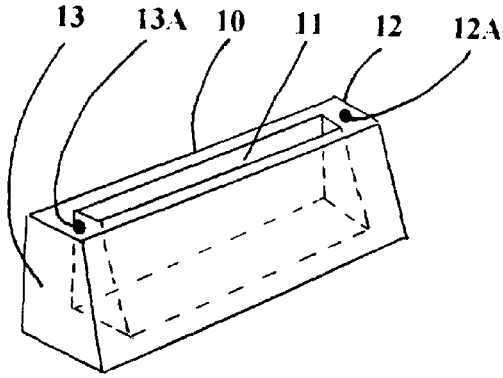
FIG. 1 is an isometric drawing of a golf club head with a rotatable shaft position at the heel end or the toe end.

In the golf club head of FIG. 1, the front face 10 of the club head has one end connected at the edge of the heel 13, while the other end has a connection at the edge of the toe 12. The club head back face connections at the heel 13 and at the toe 12 are made to the back side of the front face through the edge of the heel 13 and the toe 12. There is a space 11 between the club head front piece and the club head back piece. A rotatable shaft position at the heel is at 13A. A rotatable shaft position at the toe is at 12A.

Figure 2:
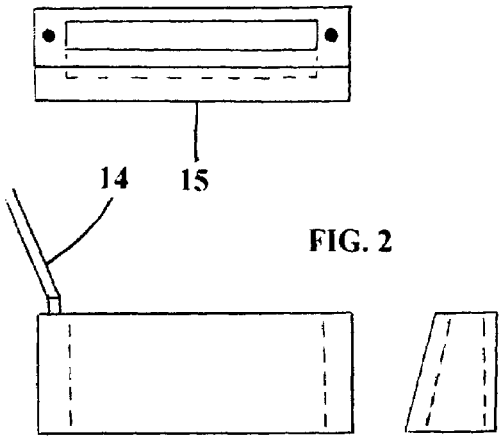
FIG. 2 shows the top view, front view and the side view of FIG. 1.

The golf club head in FIG. 2 shows a top view with the back face 15. The front view has a rotatable shaft 14 at the heel end. The side view is next to the front view.

Figure 3:
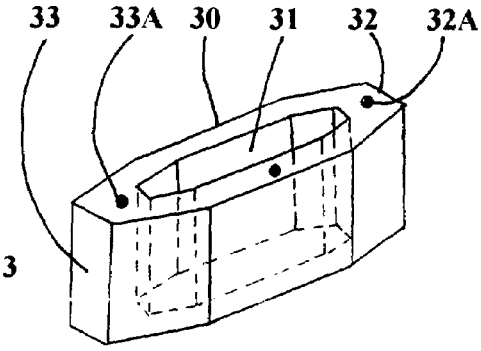
FIG. 3 is an isometric drawing of a golf club head with a rotatable shaft position at the heel end, the toe end or on the back piece.

In the golf club head of FIG. 3, the front face 30 of the club head has one end connected at the edge of the heel 33, while the other end has a connection at the edge of the toe 32. The club head back piece connections at the heel 33 and at the toe 32 are made to the back side of the front piece through the edge of the heel 33 and the toe 32. There is a space 31 between the club head front piece and the club head back piece. The three possible rotatable shaft positions are at the heel end 33A, at the toe end 32A and at 35A of the back piece shown in FIG. 4.

Figure 4:
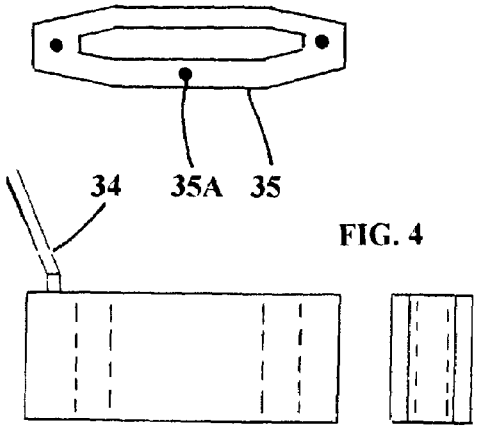
FIG. 4 shows the top view, front view and the side view of FIG. 3.

The golf club head in FIG. 4 shows a top view with the back face 35 and the back piece rotatable shaft position at 35A. The front view shows a rotatable shaft 34 at the heel position. The side view is next to the front view.

Figure 5:
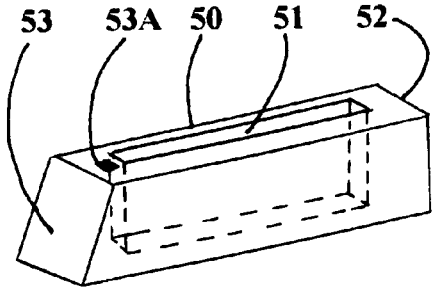
FIG. 5 is an isometric drawing of a golf club head with a rotatable shaft position at the heel end.

In the golf club head of FIG. 5, the front face 50 of the club head has one end connected at the edge of the heel 53, while the other end has a connection at the edge of the toe 52. The club head back piece connections at the heel 53 and at the toe 52 are made to the back side of the front piece through the edge of the heel 53 and the toe 52. There is a space 51 between the club head front piece and the club head back piece. The rotatable shaft position 53A is at the heel end.

Figure 6:
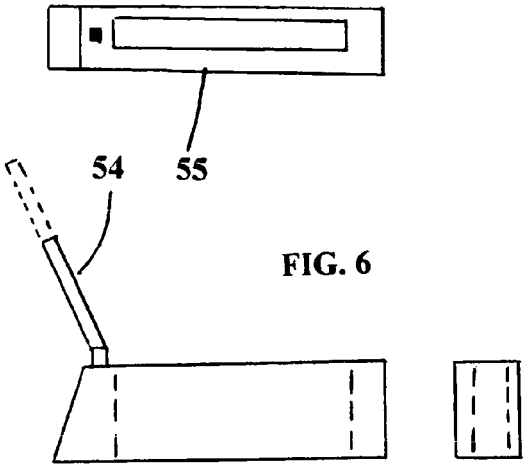
FIG. 6 shows the top view, front view and the side view of FIG. 5.

The golf club head in FIG. 6 shows a top view with the back face 55 and a front view with a rotatable telescopic shaft 54. The side view is next to the front view.

Figure 7:
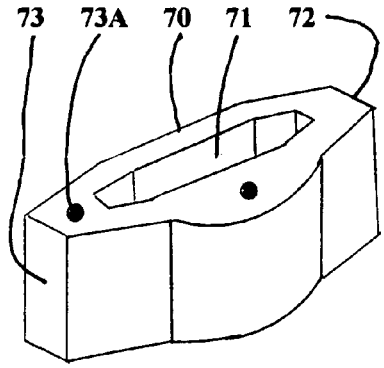
FIG. 7 is an isometric drawing of a golf club head with an extended back piece with a rotatable shaft position at the heel end or at the back piece.

In the golf club head of FIG. 7, the front face 70 of the club head has one end connected at the edge of the heel 73, while the other end has a connection at the edge of the toe 72. The club head back piece connections at the heel 73 and at the toe 72 are made to the back side of the front piece through the edge of the heel 73 and the toe 72. There is a space 71 between the club head front piece and the club head back piece. The two possible rotatable shaft positions are at the heel end 73A and at 75A of the back piece shown in FIG. 8.

Figure 8:
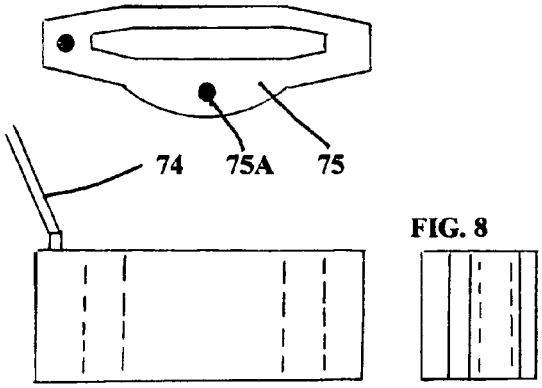
FIG. 8 shows the top view, front view, and the side view of FIG. 7.

The golf club head in FIG. 8 shows a top view with an extended back piece 75 and the back piece rotatable shaft position at 75A. The front view shows a rotatable shaft 74 at the heel position. The side view is next to the front view.

There is a big advantage in having a golf club head that has a separate front face piece and a separate back piece with a space between them and where they are attached at the heel edge and the toe edge. When this new golf club head is used to strike a golf ball with the front face, the force and inertia of the back piece will be exerted equally to the heel edge and the toe edge of the front face piece and thereby creating a larger so called 'sweet spot' at the front face. Normally, when the present day golf club head strikes a golf ball away from the middle of the front face, this can create a miss hit whereby the golf ball will take a path slightly different from what was intended because of the deflection of the front face. The use of this new type of golf club head with a space between the front piece and the back piece allows miss hits with the front face of the club head to have less of an effect on the path of a golf ball as compared to most of the golf clubs presently used.

A yardstick best illustrates the beneficial effect of this new type of golf club. Hold the yardstick near its center with the thumb and forefinger of the right hand at the nineteen inch mark and the thumb and forefinger of the left hand at the seventeen inch mark and try to exert a force at either end of the yardstick. The result of this is that the yardstick cannot exert much force at the ends although the central part of the yardstick will be quite rigid. Now hold the yardstick at each end with the thumb and forefinger of the right hand at the thirty five inch mark and the thumb and forefinger of the left hand at the one inch mark. The yardstick is much more rigid with this configuration across the whole yardstick. When the yardstick is held near their ends, a more uniform force is applied across the whole yardstick.

This same analogy applies to this new golf club head when there is a space between the front face piece and the back piece and the two pieces are attached at the heel edge and the toe edge. A ball striking front face transfers the force and inertia due to the mass and velocity of the back piece across the front face due to its attachment at the heel edge and the toe edge. The back face piece will usually have more mass than the front piece to give the front face piece more stability and inertia. The amount of mass can be small or large for the preference of a golfer for a heavier or lighter club head.

When this golf club head uses the back face piece as the ball striking face, the same advantages will apply except that now the front face piece will aid and supply a force and inertia to the back face piece. When the new club head uses the heel edge or the toe edge as the ball striking face, the club head uses its entire mass and inertia since the heel edge and the toe edge will usually be somewhat narrow compared to the front face but wide enough to adequately strike a golf ball and achieve a pendulum effect. The somewhat narrow flat surface of the heel edge or the toe edge would be nearly vertical for putting. The angle of the complimentary heel edge or toe edge could be different to resemble the normal irons whereby the angle would be somewhat in proportion to the type of iron desired. The angle of the edge could be nearly vertical to resemble the long irons (#1, 2, etc.) or less vertical for the so-called shorter irons (#8, 9, wedges etc.). The angle of the heel edge or the toe edge with respect to the vertical could be slightly different to accommodate the preference of the golfer. The present invention provides for any of a front face ball striking surface, back face striking surface, toe edge striking surface or heel edge striking surface to form an angle of between 90 and 150 degrees with respect to a horizontal surface to provide a ball striking face loft of between 0 and 60 degrees. Presently, most of the present day golf clubs with a front piece ball striking face do not usually use the heel edge or the toe edge as a ball striking face as an option. In an emergency, the golfer can use the heel edge or the toe edge of the present day golf club when the golf ball is in an unusual position. However, this does not happen too often and is not very effective because the design of the heel edge or the toe edge is not made as a ball striking face.

Some golf club manufacturers make present day golf club putters with an extended back end with the shaft placed either at the heel edge or somewhere on the back end itself. Golf club manufacturers do this in order to achieve more mass along the back end of the golf club head and thereby produce more inertia to the middle of the golf club head. The golf club head proposed here with a space between the front face and the back piece would further improve the present day golf club head with an extended back piece. This is accomplished by putting the extra inertia of the back piece to the heel edge and the toe edge and thereby tending to put the mass and inertia along the whole front face and thereby create a greater 'sweet spot' for the front face of the golf club head. Most of the present day irons (one thru wedge) have a back face essentially parallel with the front face with some sort of cavity around the perimeter of the back face giving the golf club head perimeter weighting. These new irons could have a normal or extended back piece that is more solid since the back piece will be attached at the heel edge and the toe edge of the front piece to provide additional heel and toe weighting to the golf club head. The configuration would not be as important other than the amount of mass to provide a good swing weight for the golf club. Some golfers choose to have heavier club heads, while other golfers choose to have lighter club heads. This can be achieved by making the mass of the back piece larger or smaller.

The space between the front face and the back face of the club head would not have to be empty. The golf club manufacturer could fill the space with light plastic, light foam or other light inert matter. The reason for adding this would be to prevent dirt or other debris from getting in the space and thereby changing the swing weight of the club. With this lightweight material in the space, the golf club would essentially stay the same swing weight. However, if the golfer would not mind cleaning the space between the front face and the back face, it could be left empty (the inert matter is not essential to the design of the club head).

Using the heel edge or the toe edge with its somewhat narrow flat surface and its angle with the vertical approaching that of a wedge, the golfer could use this new golf club to hit a golf ball at the edge of slightly taller grass sometimes found at some of the perimeters of the greens. A golfer does not usually use the present golf club putter in this situation because the long large bottom of the front face is slowed down by the taller grass. Sometimes a golfer will use a sand wedge or a lob wedge such that only the bottom edge of the front face of the wedge will strike the middle of the golf ball. This new putter or iron with its narrow flat surface at the heel edge or the toe edge could be used in an easier or similar manner whereby there would be much less resistance to the grass because of its narrow edge which would have a less effect on the tall grass. There is less likelihood of having a poor hit when using the heel edge or the toe edge because of the pendulum effect (angular momentum). Also, the mass and inertia of this new club head will cause the striking of the golf ball to follow the path of the swing and direction of the club head rather than whether the golf ball is struck slightly off center from the center of the heel edge or the toe edge. In this way, this new way of putting or chipping could be a permanent use of this new type of golf club. It can also be easily seen that with a space between the so called front piece and the back piece, this new golf club head can be made with more variations than the presently used golf club head and yet have the same mass or weight. Because of the space, the mass and inertia of this new club head tends to be concentrated on the outside toe edge and heel edge of the front piece.

With the shaft located at the central part of the back piece, the heel edge can be used for a right handed golfer and the toe edge can be used for the left-handed golfer. The golfer can use this heel edge of this club head for right-handed putting and the toe edge for left handed chipping. A golfer could use a separate golf club that is not as narrow for chipping or approaching. The fundamental reason for using the heel edge or the toe edge as a standard is to achieve a more accurate line and movement of the golf ball because of the pendulum effect. This occurs because the golf ball will have less chance of being miss hit and will more faithfully follow the path and direction of the line of the moving club head. With the shaft at the heel end, the front face will be used by the right-handed golfer, while the back face will be used if the golfer is left-handed. However, a right-handed golfer could use both the front face and the back face but would essentially swing one right handed and the other left handed. It can be seen that the front face or the back face could be used for putting or as an iron (2, 3, 8, 9 or wedge) with different lofts. All sort of combinations are possible depending on what the individual golfer personally desires. The whole set of irons made this way will produce more consistent striking of the golf ball. It might also be desirable to have these so-called irons also have the heel edge and the toe edge to have a ball-striking surface. The golfer could also use the club in an emergency when the golf ball is up close to some object (like a bush or tree) and a normal swing is not easily possible.

With respect to versatile type golf clubs, the USGA has some strict rules in terms of the construction of a golf club. Therefore, some modifications referred to in the following paragraphs might not be acceptable with these golf clubs in competition. However, the amateur golfer would have the ability to use the various functions in practice or on a golf course to determine what works best. For competitive play, a golfer would have to use the golf club in a fixed mode.

The golf club shaft 14, 34, 54 and 74 will fit into its connecting socket part 12A, 13A, 32A, 33A, 35A, 53A, 73A and 75A and is able to rotate 360 degrees around the socket to a normal address of the club head to utilize striking the golf ball with the different parts of the club head. The normal rotation of the rotatable shaft would be approximately ninety degrees in order to achieve a normal address position to strike a golf ball with either of the heel edge, toe edge, front face or back face. However, something within range of ninety degrees is also possible for the convenience and experimentation of the golfer. This adjustment of different address positions can be made permanent (having two or more different golf clubs) or can be done through adjustments made with one club.

The golf club manufacturer can create this adjustment of securing the shaft to the different address positions with such mechanical items (but not limited to) as springs, clamps, screws, lock pins, screw threads, etc. The adjustment will not work for the professional golfer in a round of golf because the USGA rules prohibit multi use of golf clubs under current rules. However, the golfer could permanently fix the address position during the round of golf and make the address position adjustable only during practice.

For simplicity, instead of the shaft being able to be rotatable continuously thru three hundred and sixty degrees, it might be desirable to have a square socket on the club head whereas the shaft would have a square end. This would make the addressing situation simpler for the golfer by having only four unique positions to be able to use any of the ball striking faces. However, for the more mature golfer, the continuously rotatable shaft is more desirable for complete flexibility. For some of the present day golf clubs the front face is not parallel with the addressing of the shaft. The amateur golfer advances or retards the toe of the front face of the club head to minimize slicing or hooking of the golf ball. Usually the slicing or hooking of the golf ball is due to an improper swing usually due to striking a golf ball with an open front face or slightly closed front face rather than being normal to the swing path. By having the shaft rotatable thru the three hundred sixty degrees, the golfer can adjust the shaft away from the normal addressing position, which is slightly more or less than the normal ninety degrees and thereby advancing or retarding the toe of the club head to simulate the open or closed position of the club head. This feature might even help the professional golfer to hit a golf ball with less hooking or slicing as compared to the normal addressing of the golf club head front face.

This invention also incorporates an adjustable length shaft. This invention accomplishes this in two ways. One way would be to have the manufacturing of the shaft adjustable and clamped at two or more different positions. Another way is to have the shaft adjustable in a telescopic manner. Many golf ball retrievers and tree limb cutters are made in this way. This would be particularly advantageous for the golf club putter, since many times the golfer uses the putter in a shorter choke position for short putts with the hands on the shaft itself. The golfer does this to achieve better control of the club head by having the club head closer to the hands. By having the adjustable length shaft, the golfer would be able to hold the golf club putter with the grip itself rather than on the shaft. This would insure a better grip in order to strike the golf ball with more firmness. The adjustable length shaft would also be useful in the use of the irons or even the woods. A longer shaft will usually hit a golf ball further than a shorter shaft because of a longer lever arm. Usually with the shorter irons as in the wedge, the golfer only swings a half or three quarter swing to achieve less distance in approaching a green. By having an adjustable length shaft, one could use a fuller swing to achieve a shorter distance. In addition, when near the green, the golfer uses a wedge for short distances to go over the taller grass before the green. Here again, a choke position is often used to achieve better control. The adjustable shaft length would also be very useful here by having the hands on the grip for a better control of the golf club head.

It is a further object of the invention to provide a golf club that has a plurality of ball striking faces available with a single golf club.

It is a further object of the invention to provide a golf club that improves the balance, swing and contact area of the golf club.

It is a further object of the invention to provide more confidence with better control and feel by using a golf club that moves a golf ball on a desired path rather than having the ball go off-line because of a poor hit.

It is a further object of the invention that these new golf clubs provide a larger 'sweet spot' than the present day golf clubs do.

It is a further object of the invention to provide a golf club that minimizes the contact with the golf course surface by using the narrow flat surface at the bottom of the heel edge or the toe edge.

It is a further object of the invention that provides an improved way of putting.

It is a further object of the invention to provide a golfer with a golf club that is usable with the different ball striking surfaces by rotating the shaft and achieving the proper address positions for the particular ball-striking surface.

It is a further object of the invention to provide a golfer with a golf club with different lengths of the shaft.

It is a further object of the invention to provide a golf club that is more suitable for practice for all golfers by having the ability to change the characteristics of the golf club.

It is a further object of the invention to provide a golf club for the amateur that makes the game of golf easier and more forgiving through the versatility of the golf club.

It is a still further object of the invention to provide golf clubs that can improve a player's score by being more forgiving to miss hits by having a larger 'sweet spot' and developing more confidence when using these new golf clubs.

Other objects and advantages will become more apparent from the detailed description of the preferred embodiments and the accompanying drawings.

I claim:

1. A golf club comprising:

a) a club head having a solid front piece, a solid back piece, a solid heel edge piece and a solid toe edge piece;

b) said front piece and said back piece being connected to said heel edge piece and to said toe edge piece to form a perimeter of said club head, resulting in an exposed and open central portion extending through an overall height from a top to a bottom of said club head, with a completely unobstructed space between the club head front piece and the club head back piece throughout the central portion;

c) said front, back, heel edge and toe edge pieces forming an integral club head body having an overall length and width; each of said front and back pieces having a substantially equal length that is greater than the length of either of the heel edge and toe edge pieces; said space spanning generally the entire volume of said club head body defined by the overall length, width and height and within the perimeter delineated by said pieces;

d) said club head body having one or more ball striking surfaces, wherein the ball striking surface is a front face striking surface, a back face striking surface, a heel edge striking surface or a toe edge striking surface; said one or more ball striking surfaces forming an angle of between 90 to 150 degrees with respect to a horizontal plane to provide said ball striking surface with a face loft of between 0 and 60 degrees;

e) a shaft rotatably adjustable and removably attached to said top of said club head in at least one of a heel, toe or central portion of the perimeter of said club head body, wherein said shaft may be interchangeably used in combination with any selected one of said one or more ball striking surfaces to address a golf ball.

* * * * *